US005454234A

United States Patent [19]

Karmeli

[11] Patent Number: 5,454,234

[45] Date of Patent: Oct. 3, 1995

[54] PROCESS AND RESULTING JEWELRY STONE PRODUCT

[76] Inventor: David D. Karmeli, 3 Grasspark, London N3, England

[21] Appl. No.: 212,280

[22] Filed: Mar. 14, 1994

[51] Int. Cl.[6] ..... A44C 17/02

[52] U.S. Cl. ..... 63/28; 63/32

[58] Field of Search ..... 63/32, DIG. 3, 63/28

[56] References Cited

U.S. PATENT DOCUMENTS

| | | | |
|---|---|---|---|
| 286,023 | 10/1883 | Lancon | 63/32 |
| 1,131,593 | 3/1915 | Bashor | 63/26 |
| 1,308,011 | 6/1919 | Gilsey | 63/26 |
| 1,377,130 | 5/1921 | Hashimoto | 63/32 |
| 1,421,329 | 6/1922 | Welch | 63/32 |
| 1,730,257 | 10/1929 | Welch | 63/32 |
| 1,912,602 | 6/1933 | Stonberg | 63/32 |
| 2,447,407 | 8/1948 | Grain | 63/32 |
| 4,604,876 | 8/1986 | Hoffmann | 63/32 |
| 4,809,417 | 3/1989 | Normann, Jr. | 63/32 |
| 5,090,216 | 2/1992 | Waugh | 63/32 |

FOREIGN PATENT DOCUMENTS

| | | | |
|---|---|---|---|
| 2256955 | 11/1972 | Germany | 63/32 |

*Primary Examiner*—Michael J. Milano
*Attorney, Agent, or Firm*—Notaro & Michalos

[57] ABSTRACT

A jewelry stone assembly comprises upper and lower stone portions which are adhesively attachable to each other at mating surfaces. One or more blind cavities are formed in the mating surface of the lower stone portion and a jewel alone or jewel with setting is dropped into the cavity. Thereafter, clear adhesive is used to attach the upper and lower stone portions at their mating surfaces and the outer surface of the assembled outer stone is further processed, for example by faceting, to produce an outer stone which contains at least one inner stone.

17 Claims, 2 Drawing Sheets

PROCESS AND RESULTING JEWELRY STONE PRODUCT

FIELD AND BACKGROUND OF THE INVENTION

The present invention relates in general to jewelry, and in particular to a new and useful process and product comprising an outer stone which embeds an inner, usually more precise stone.

The use of real and synthetic stones in rings, necklaces, broches and other jewelry settings is well known. This includes precious stones such as diamonds, as well as semiprecious stones and even synthetic stones. For instance, such stones can be cut or formed into gem shapes as can cubic zirconia and certain synthetic materials. The stones can be colorless or have a color tint.

The higher priced stones, such as diamonds, are usually available down to very small sizes whereas the semiprecious or synthetic stones are usually provided in larger sizes.

SUMMARY OF THE INVENTION

An object of the present invention is to provide an outer stone which contains one or more blind cavities that receives an inner stone. Generally the outer stone is either semiprecious or synthetic while the inner stone is a diamond or other precious yet smaller gem.

This produces a unique visual effect as one looks into the transparent outer stone and views the inner stone. The invention may also be used to produce an audible effect, if the inner stone is loosely held within its blind cavity so that it can move and produce a tapping sound as the outer stone is moved.

A further object of the present invention is to provide a unique process for manufacturing the product of the invention.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiment of the invention is illustrated.

DESCRIPTION OF THE PREFERRED EMBODIMENTS

Figure 5:
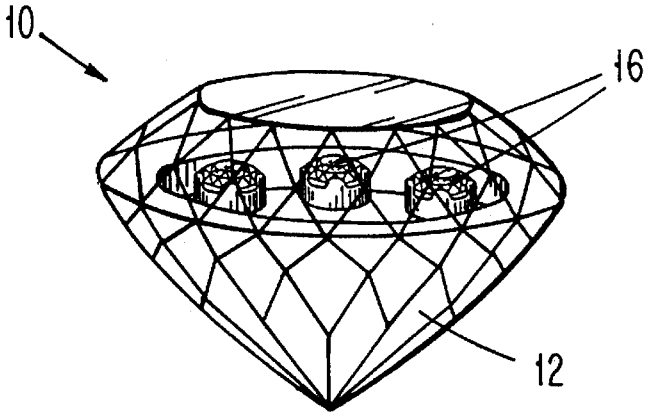
FIG. 5 is a perspective view of the completed product according to the present invention.

Referring to the drawings in particular, the invention embodied in FIG. 5 comprises a jewelry stone assembly generally designated 10 made up of an outer stone 12 and one or more inner stones 16 loosely or firmly held within at least one blind cavity defined within the body of the outer stone 12.

The jewelry stone assembly 10 is manufactured in accordance with the invention.

Figure 1A:
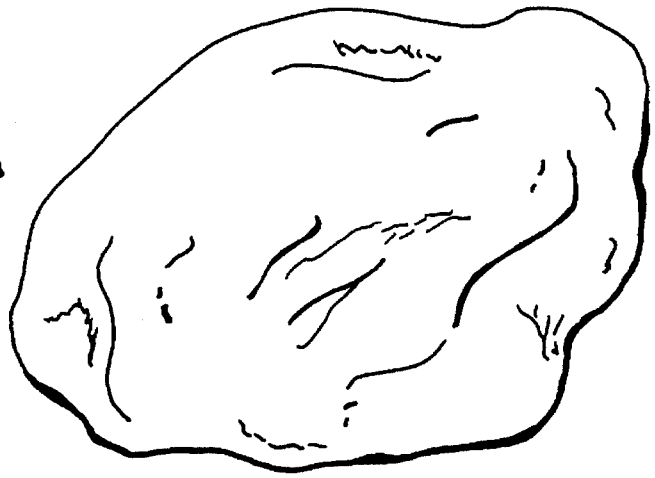
FIG. 1A is a perspective view of a raw stone before a first operating step of cutting it into two parts of the invention.
Figure 1B:
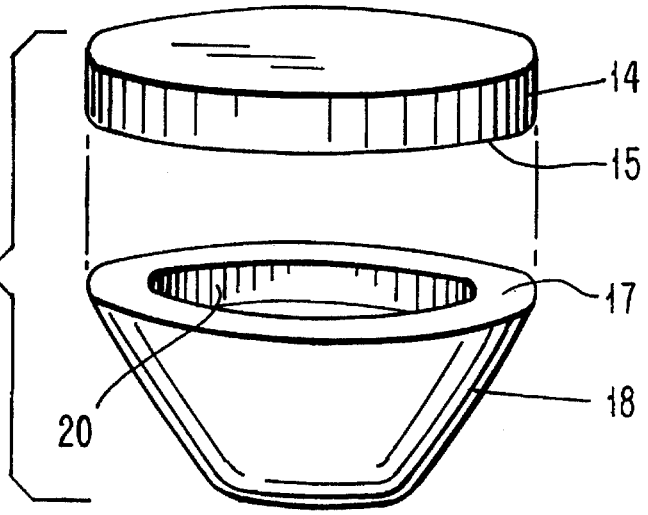
FIG. 1B is an exploded view showing two parts of the outer stone during a preliminary stage in the process of the invention.

In an initial step of the invention illustrated in FIG. 1B, a raw material for the outer stone shown in FIG. 1A is selected. This may for example, be any one of a variety of semiprecious stones or synthetic material stones or even precious stone material. Examples of natural materials which can be used for the outer stone are amethyst, blue topaz, white topaz, citrine, garnet, tourmaline, white quartz, pink quartz, aquamarine and other semiprecious and precious gemstones.

Examples of synthetic or man-made raw materials are, cubic zirconia, yag, boules synthetics, synthetic quartz, etc.

After the raw material is selected, pieces of the raw material are preformed into desired shapes for an upper stone portion 14 and a lower stone portion 18. For example, the stone portions may be cut into round, oval, heart or other contours which roughly match the upper and lower portions of the outer stone 12 in its assembled state.

Advantageously, the raw material of upper and lower stone portions 14, 18 is transparent so that one can peer into the volume of the stone portions. Although this is a preferred embodiment of the invention, alternatively either one, preferably the upper stone portion is transparent while the lower stone portion 18 is translucent or opaque.

At this stage of the process, at least roughly planer mating surfaces 15 and 17 are provided on the underside of the upper stone portion 14, and the upper side of the lower stone portion 18 respectively. These will ultimately mate with each other to form the outer stone 12.

Depending on the raw material and the condition of the rough stone, the preforming process can either be done on a preforming machine of conventional design or totally by hand using appropriate grinding devices, depending on the rough stone. Although the process is done separately for both top and bottom portions, in an alternate embodiment of the invention, a single rough stone is cut into the approximate shape of FIG. 4, and then cut along a plane to divide the single outer stone into separate upper and lower stone portions with the flat surfaces 15, 17 as shown in FIG. 1.

FIG. 1B also shows a subsequent step in the process where at least one or, if desired, a plurality of blind cavities 20 are formed in the upper surface 17 of stone portion 18. While in the example of FIG. 1B, one cavity is shown, more than one cavity may be used. To form the cavity or cavities, a cavity is first dug out using an ultrasonic drill. The ultrasonic drill is modified as follows:

The main problem with all ultrasonic drills in stock form is the vibrations that occur during the drilling process. Ordinarily for the processes that these machines were designed for these vibrations are not that important, but for the inventive production, that requires hollowing out the center of a small fragile stone leaving a thinner than normal wall, these excessive vibrations can cause chipping or breakage to the stone. For this reason, the first modification is to the drill head and the shaft attached to the head. Ordinarily, in stock form the moveable head of the machine is lowered onto the surface that it is supposed to cut. The moveable head is not as secure as a fixed head and neither is the shaft that the head is attached to. The first modification is replacing the shaft with a sturdier steel shaft and fixing the head to the shaft permanently for vibration free operation.

The next modification is creating a moveable platform to be raised incrementally toward the machine head. The moveable platform is the key to successful and accurate cavities. Not only should the rate of the raising be timed according to the excavating speed of the machine for different material, it should also be calibrated for the death of each cavity.

A next major difficulty is devising a system for holding the stones securely in place during the excavating operation. Both the hardness (or the lack of it) and the different forms and sizes combined with rounded surfaces of the stones plus variations in dimensions of height, length and width pose serious problems, and also the stones need to be perfectly centered before the drilling operation. For the purpose of holding the stones, a jig is used which comprises a stainless steel frame and base with vertical and lateral adjustments. The center of the frame is filled with a special type of stiff vulcanizing rubber first. Then a metal model of the stone is placed in the rubber and the whole jig is vulcanized. After vulcanization, one can remove the metal form and in its place there is an indentation within the rubber. In this indentation one can place the matching stone to be held securely for the excavating process. The same process should be repeated for each size and every shape of stone that is cut. The stiff vulcanized rubber is the heart of the jig, not only does the rubber hold the stone tightly without damaging the stone's surface, it also allows for small variations in the stone measurements while cushioning it during the excavation.

The next step is creating sized and shaped dies for creating the hole(s) in the stones.

Thus, during the drilling process, the stones are held in place in the specialized jig which although firmly holding the stones, does not scratch them or chip them.

Figure 2:
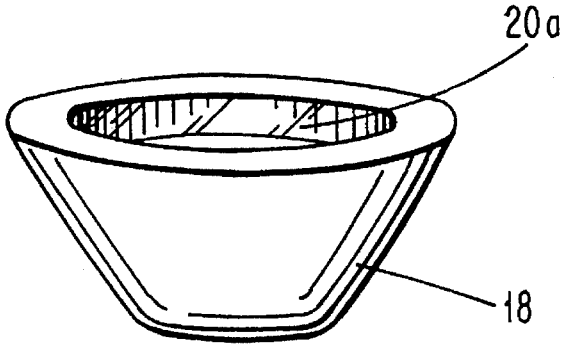
FIG. 2 is a view of the bottom portion of the outer stone after at least one cavity has been formed in an exposed mating plane of the stone.

After the rough cavity or cavities are formed, the interior surfaces are polished and evened out manually. This produces transparent walls to the blind cavity at 20*a*, so that its interior can be viewed from outside the outer stone, as shown in FIG. 2.

Figure 3:
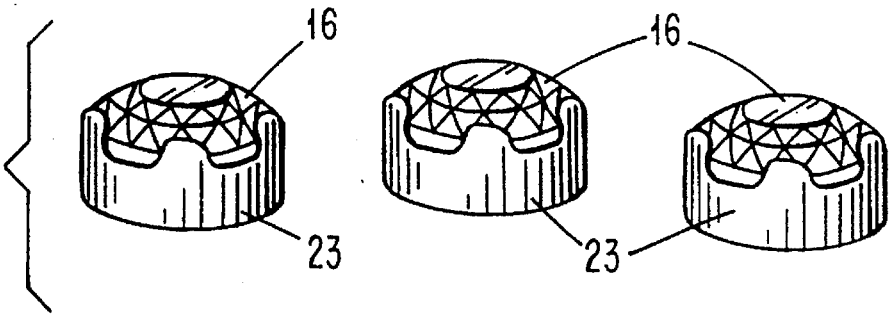
FIG. 3 is a view of inner mounted stones to be deposited into the cavity.

As shown in FIG. 3, the next step is to insert smaller or inner stones 16 into each of the polished, blind cavity 20*a*. Diamonds are the preferred stone and may be inserted by themselves or first mounted in a gold stone setting which is selected so that each diamond has an upper surface that is just slightly below the plane of mating surface 17 of lower stone portion 18. To adjust the level of the upper surface of the diamonds in their respective blind cavities 20, different thicknesses of the gold stone setting 23 may be used. In this way the height of the gem or gem plus setting can be adjusted to substantially match the depth of the cavity.

Instead of diamonds, alternate stones which can be inserted into the blind cavity 20 are ruby, sapphire, emerald or any of the aforementioned raw materials used for the outer stone portions 14 and 18. The stones may be set in gold setting 23 or can be rough, smooth or slightly polished stones which float freely in the cavities.

Figure 4:
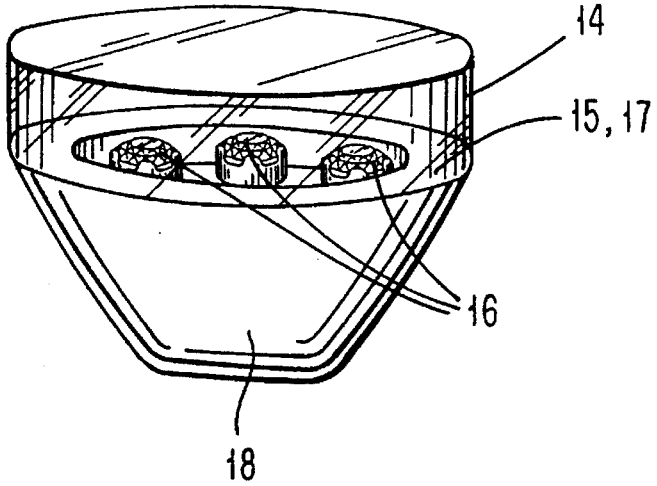
FIG. 4 is a view of the partially completed outer stone with the stone halves having been assembled.

The bonding of the two parts 14 and 18 of the outer stone is one of the most critical steps in the process and is shown in FIG. 4.

As illustrated in FIG. 4 the cementing together of the upper and lower stone portions takes place at the now mated mating surfaces 15, 17, using a preferably transparent specialized cement which is selected depending on the material of the stone portions to be attached to each other. Examples of the specialized cements adhesives or glues used are, ultraviolet curing adhesives and heat curing adhesives. Example of the UV glue is LOCKTITE UV GLUE, a trade name for an ultraviolet curing glue, and 3M heat bonding glue. These are colorless, watertight and can be used with the materials of the outer stone according to the present invention.

A UV adhesive can be used which sets by exposing it to a selected frequency of UV light for a predetermined period of time. The exposure process is usually done in an enclosed box. The stones can be either placed individually in the box, or moved through the box on a conveyer belt with a set speed.

The bonding characteristics of the adhesive varies according to the type, color and size of the material being used. For example, a blue topaz 8 mm× 10 mm oval stone requires an exposure time of 5.5 minutes to bond properly. An equivalent amethyst stone bonds in 3 minutes. If the amethyst is left any longer than 3 minutes the adhesive will start to form bubbles. This is due to the fact that the UV light also generates heat, and if the adhesive is over exposed its characteristics will change and the air trapped in the adhesive will start to expand. The bubbles affect the integrity of the adhesive or glue. Again, different sizes of the stones need different setting times, due to differences in surface areas to be bonded. As explained above, each kind of material and size of stone needs its own time calibration.

Another bonding problem occurs due to the color of the material being glued together. For, example the UV glue does not work properly with yellow colored stones like citrine. The bonding is generally weak and full of bubbles. Also the glue sometimes forms a rainbow effect which affects the stone's visual characteristics. In these cases, one must use other kinds of specialty adhesives. These adhesives also have to be calibrated according to the type and size of material used.

Another major problem is the actual application of the glue. This is important since if there is not enough glue, the bonding process will be weak and create an uneven seal. This would affect the strength and water tightness of the finished product. On the other hand, if too much glue is applied, even in minute quantities since it is still in liquid free form, at the time of joining the two halves together, the pressure will force a small quantity of the glue inside the cavity area where the free floating stones are. This usually goes un-noticed until the glue is set and the stone is finished. The glue inside the cavity would hinder the movement of the free-floating stones and in some cases they would stick to the bottom of the cavity, and since the stone has to be faceted and re-gridled after each gluing, the stone has to be totally rejected since one cannot re-gridle the stone at this point.

After the bonding process, the stones have to be checked for water-tightness with special equipment, like those used in the watch industry. As explained above, the water-tightness is dependant on proper application and setting of the glue, along with accurate re-gridling and faceting.

If the stone passes both tests for water tightness and bonding quality it continues to a final facetting and polishing step to produce the cut-stone effect shown in FIG. 5. After this, a final check for quality is conducted.

While a specific embodiment of the invention has been shown and described in detail to illustrate the application of the principles of the invention, it will be understood that the invention may be embodied otherwise without departing from such principles.

What is claimed is:

1. A process for manufacturing a jewelry stone assembly comprising:

providing upper and lower stone portions each having a mating surface which can be mated together to form an outer stone;

defining at least one blind cavity in the mating surface of the lower stone portion;

mounting an inner stone in a setting;

thereafter placing the inner stone with setting in the blind cavity;

applying adhesive between the mating surfaces and engaging the mating surfaces of the upper and lower stone portions to each other; and allowing the adhesive to cure to permanently fix the upper and lower stone portions to each other to form the outer stone, which contains the inner stone and setting in the at least one cavity.

2. A method according to claim 1 including preforming the upper and lower stone portions into an approximate shape corresponding to the finished outer stone before the cavity is placed in the lower stone portion.

3. A method according to claim 2 including faceting outer surfaces of the outer stone to finish the outer surface of the outer stone.

4. A method according to claim 1 wherein the upper and lower stone portions are transparent, the adhesive used to attach the upper and lower stone portions to each other being transparent.

5. A method according to claim 4 including forming the at least one cavity by first rough cutting the cavity and thereafter polishing and finishing inner surfaces of the cavity.

6. A method according to claim 1 including forming the cavity to be larger than the inner stone so that with the upper and lower stone portions adhered to each other and the inner stone in a cavity, the inner stone moves within the cavity.

7. A method according to claim 1 wherein the upper and outer stone portions are made of materials selected from the group consisting of amethyst, blue topaz, white topaz, citrine, garnet, tourmaline, white quartz, pink quartz, aquamarine, glass, cubic zirconia, yag, boules synthetics and synthetic quartz.

8. A method according to claim 7, wherein the adhesive is selected from the group consisting of optically clear UV curing adhesive and optically clear heat curing adhesive.

9. A method according to claim 8, wherein the inner stone is selected from the group consisting of amethyst, blue topaz, white topaz, citrine, garnet, tourmaline, white quartz, pink quartz, aquamarine, cubic zirconia, yag, boules synthetics, synthetic quartz, diamond, ruby, sapphire and emerald.

10. A method according to claim 1, wherein the upper and lower stone portions are both optically clear, the method including polishing an inner surface of the blind cavity after it is defined so that an inner stone in the blind cavity is visible outside the jewelry stone assembly.

11. A jewel stone assembly comprising:

upper and lower stone portions having mating surfaces which are bonded to each other with a transparent adhesive, the bonding surface of the lower stone portion containing at least one blind cavity, and an inner stone with a metal setting thereon, in the cavity.

12. A jewel stone assembly according to claim 11, wherein the upper and lower stone portions are transparent and are selected from the group consisting of amethyst, blue topaz, white topaz, citrine, garnet, tourmaline, white quartz, pink quartz, aquamarine, glass, cubic zirconia, yag, boules synthetics and synthetic quartz.

13. A jewel stone assembly according to claim 12, wherein the inner stone is selected from the group consisting of amethyst, blue topaz, white topaz, citrine, garnet, tourmaline, white quartz, pink quartz, aquamarine, glass, cubic zirconia, yag, boules synthetics, synthetic quartz, diamond, ruby, sapphire and emerald.

14. A jewel stone assembly according to claim 11, wherein the upper and lower stone portions have outer facets.

15. A jewel stone assembly according to claim 11, wherein the cavity is larger than the inner stone so that inner stone freely moves in the cavity.

16. A jewel stone assembly comprising:

upper and lower stone portions having mating surfaces which are bonded to each other with a transparent adhesive, the bonding surface of the lower stone portion containing at least one blind cavity, and an inner stone with a setting in the cavity; the stone assembly being made by the process comprising:

providing upper and lower stone portions each having a mating surface which can be mated together to form an outer stone;

defining at least one blind cavity in the mating surface of the lower stone portion;

mounting an inner stone in a setting;

placing the inner stone with setting in the blind cavity;

applying adhesive between the mating surfaces and engaging the mating surfaces of the upper and lower stone portions to each other; and allowing the adhesive to cure to permanently fix the upper and lower stone portions to each other to form the outer stone, which contains the inner stone with setting in the at least one cavity.

17. A product by a process according to claim 16, wherein the adhesive and the upper and lower stone portions are transparent.

* * * * *